US010436460B2

(12) United States Patent
Cha et al.

(10) Patent No.: US 10,436,460 B2
(45) Date of Patent: Oct. 8, 2019

(54) AIR CONDITIONER HAVING ENGINE AND GENERATOR

(71) Applicant: LG ELECTRONICS INC., Seoul (KR)

(72) Inventors: Wooho Cha, Seoul (KR); Baikyoung Chung, Seoul (KR); Song Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 387 days.

(21) Appl. No.: 15/028,088

(22) PCT Filed: Nov. 4, 2014

(86) PCT No.: PCT/KR2014/010534

§ 371 (c)(1),
(2) Date: Apr. 8, 2016

(87) PCT Pub. No.: WO2015/076509

PCT Pub. Date: May 28, 2015

(65) Prior Publication Data

US 2016/0252261 A1 Sep. 1, 2016

(30) Foreign Application Priority Data

Nov. 20, 2013 (KR) ..... 10-2013-0141207

(51) Int. Cl.
*F25B 6/04* (2006.01)
*F24F 1/44* (2011.01)
(Continued)

(52) U.S. Cl.
CPC ..... *F24F 1/44* (2013.01); *F24F 1/0003* (2013.01); *F24F 1/06* (2013.01); *F24F 1/08* (2013.01);
(Continued)

(58) Field of Classification Search
CPC ..... F25B 25/005; F25B 2700/1933; F25B 31/006; F25B 6/04; F25B 2600/022
See application file for complete search history.

(56) References Cited

U.S. PATENT DOCUMENTS 6,516,622 B1 * 2/2003 Wilson ..... B01D 53/265 62/228.3
2005/0044866 A1 * 3/2005 Shaw ..... F25B 1/10 62/160
(Continued)

FOREIGN PATENT DOCUMENTS

JP 07-174434 A 7/1995
JP 2001-099519 4/2001
(Continued)

OTHER PUBLICATIONS

International Search Report dated Feb. 5, 2015 issued in Application No. PCT/KR2014/010534.
(Continued)

*Primary Examiner* — David J Teitelbaum
(74) *Attorney, Agent, or Firm* — KED & Associates LLP

(57) ABSTRACT

Provided are an air conditioner and a method of controlling the same. The air conditioner includes an indoor unit including an indoor heat exchanger, a first outdoor unit connected to the indoor unit, the first outdoor unit including a first compressor compressing a refrigerant and a first outdoor heat exchanger, a second outdoor unit including an engine generating a power by using combustion gas, a generator supplying electricity into the first compressor by using the power generated in the engine, a second compressor compressing the refrigerant by using the power of the engine, and a second outdoor heat exchanger, and a controller determining an additional operation of the second compressor on the basis of required cooling or heating load while the first compressor operates.

11 Claims, 6 Drawing Sheets

(51) Int. Cl.

| | |
|---|---|
| ***F24F 1/0003*** | (2019.01) |
| ***F24F 1/06*** | (2011.01) |
| ***F24F 1/08*** | (2011.01) |
| ***F24F 13/30*** | (2006.01) |
| ***F25B 13/00*** | (2006.01) |
| ***F25B 31/00*** | (2006.01) |
| ***F25B 49/02*** | (2006.01) |
| ***F24F 11/30*** | (2018.01) |
| *F25B 25/00* | (2006.01) |
| *F24F 110/00* | (2018.01) |
| *F24F 140/12* | (2018.01) |
| *F24F 140/20* | (2018.01) |
| *F24F 140/50* | (2018.01) |
| *F24F 11/83* | (2018.01) |

(52) U.S. Cl.

CPC ..... *F24F 11/30* (2018.01); *F24F 13/30* (2013.01); *F25B 6/04* (2013.01); *F25B 13/00* (2013.01); *F25B 31/008* (2013.01); *F25B 49/022* (2013.01); *F24F 11/83* (2018.01); *F24F 2110/00* (2018.01); *F24F 2140/12* (2018.01); *F24F 2140/20* (2018.01); *F24F 2140/50* (2018.01); *F25B 25/005* (2013.01); *F25B 31/006* (2013.01); *F25B 2313/0253* (2013.01); *F25B 2400/14* (2013.01); *F25B 2600/022* (2013.01); *F25B 2700/1933* (2013.01)

(56) References Cited

U.S. PATENT DOCUMENTS

| | | | | |
|---|---|---|---|---|
| 2007/0056300 | A1* | 3/2007 | Crane | F25B 49/025 62/175 |
| 2011/0048054 | A1* | 3/2011 | Sekine | F25B 13/00 62/324.6 |
| 2014/0318170 | A1* | 10/2014 | Katoh | F28F 9/26 62/324.5 |

FOREIGN PATENT DOCUMENTS

| | | | | | |
|---|---|---|---|---|---|
| JP | 2002-168540 | A | | 6/2002 | |
| JP | 2004-060953 | A | | 2/2004 | |
| JP | 2010-276276 | A | | 12/2010 | |
| JP | 2012067958 | A | * | 4/2012 | F25B 31/006 |
| KR | 10-2012-0070006 | A | | 6/2012 | |

OTHER PUBLICATIONS

European Search Report dated Jun. 28, 2017 issued in Application No. 14864185.5.

* cited by examiner

[Fig. 1]
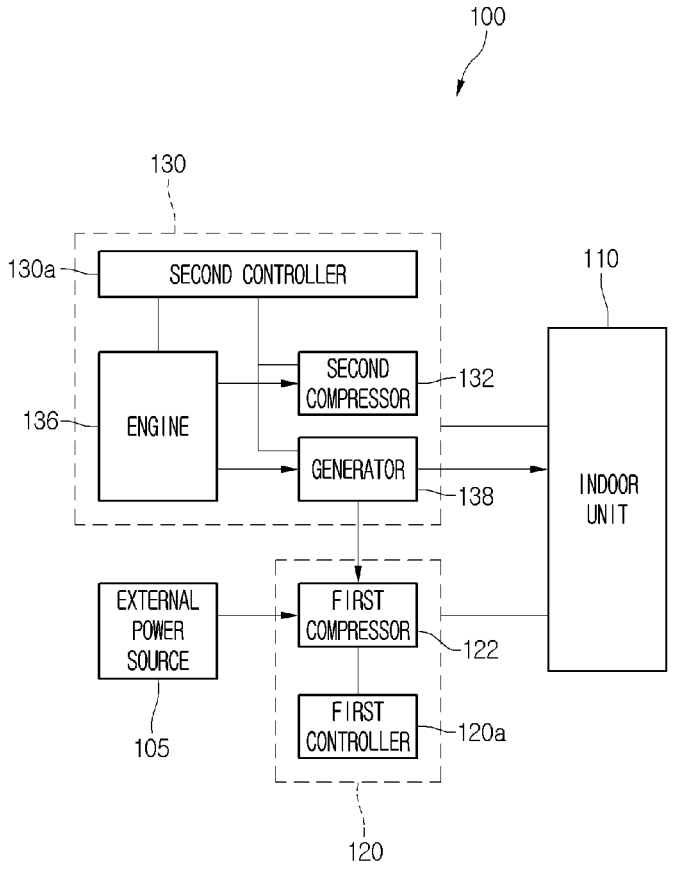

[Fig. 2]
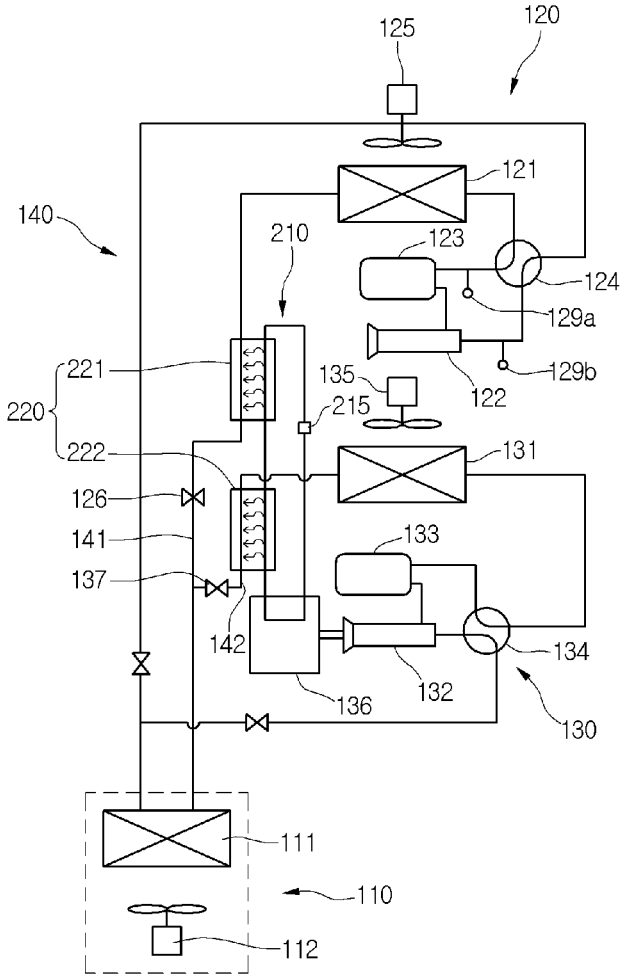

[Fig. 3]
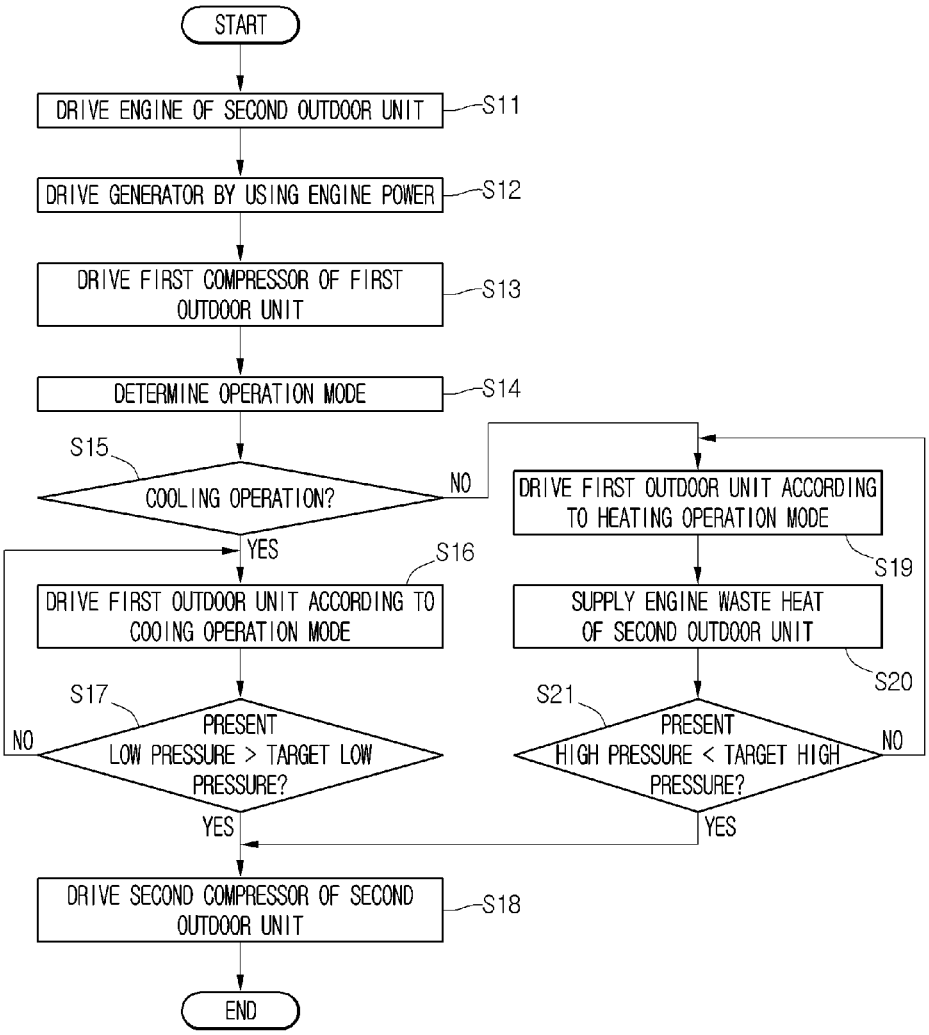

[Fig. 4]
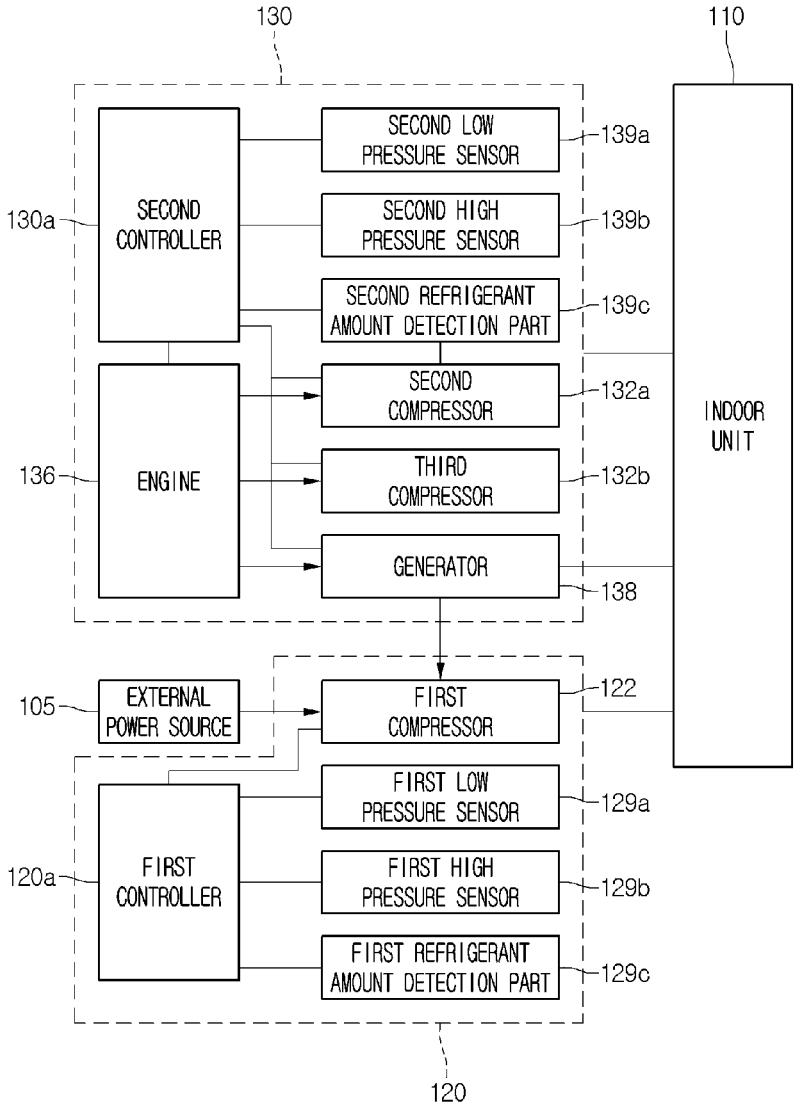

[Fig. 5]
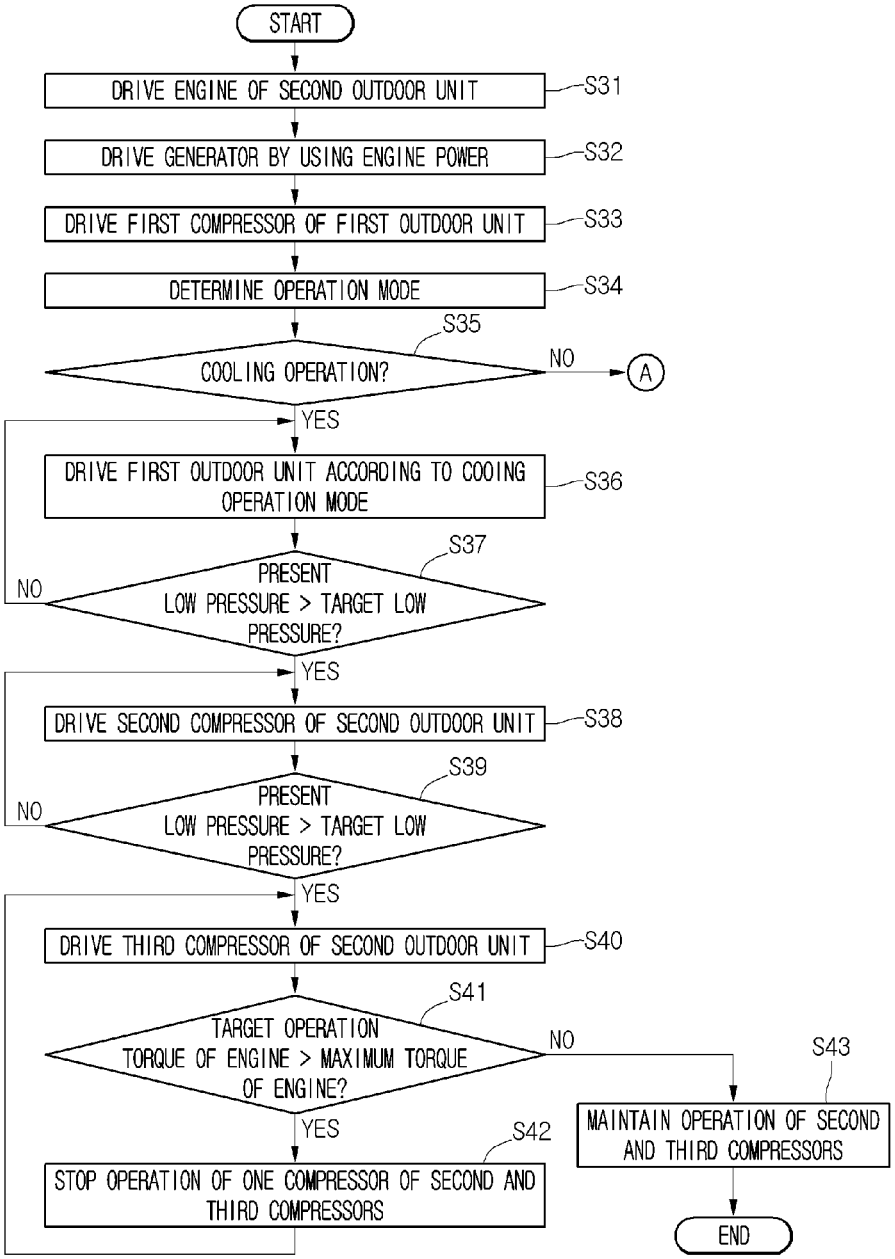

[Fig. 6]
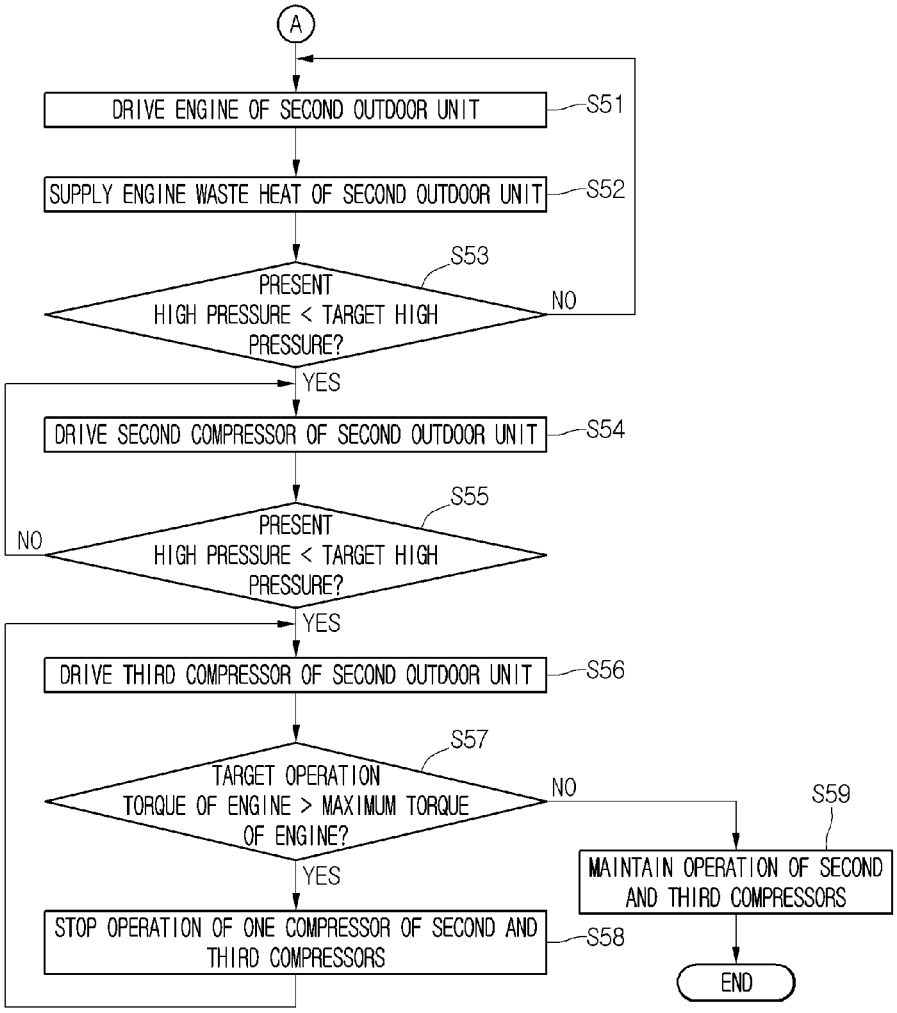

AIR CONDITIONER HAVING ENGINE AND GENERATOR

CROSS-REFERENCE TO RELATED PATENT APPLICATIONS

This application is a U.S. National Stage Application under 35 U.S.C. § 371 of PCT Application No. PCT/KR2014/010534, filed Nov. 4, 2014, which claims priority to Korean Patent Application No. 10-2013-0141207, filed Nov. 20, 2013, whose entire disclosures are hereby incorporated by reference.

TECHNICAL FIELD

The present disclosure relates to an electric heat pump (EHP) type and gas heat pump (GHP) type air conditioner and a method of controlling the same.

BACKGROUND ART

Air conditioners are apparatuses for cooling/heating or purifying air in an indoor space in order to provide more comfortable indoor environment to a user.

Such an air conditioner may be classified into a split type air conditioner in which indoor and outdoor units are separated from each other and an integral type air conditioner in which indoor and outdoor units are integrally coupled to each other as a single unit. Air conditioners may also be classified into single type air conditioners having capacity that is capable of operating one indoor unit so as to be used in narrow spaces, middle and large sized air conditioners having very large capacity so as to be used in companies or restaurants, and multi type air conditioners having capacity that is capable of sufficiently operating a plurality of indoor units according to the capacity thereof.

Here, such a split type air conditioner includes an indoor unit installed in an indoor space to supply hot wind or cold wind into a space to be air-conditioned and an outdoor unit in which compression and expansion are performed for performing a sufficient heat-exchanging operation in the indoor unit.

Also, the air conditioner may be classified into an electric heat pump (EHP) type air conditioner and a gas heat pump (GHP) type air conditioner according to power sources for driving a compressor. The EHP type air conditioner uses electricity as a power source for the compressor, and the GHP type air conditioner uses a fuel such as an LNG or LPG as a power source for the compressor. In the GHP type air conditioner, an engine operates through fuel combustion to provide an output of a compressor motor.

A prior art document relating to the GHP type air conditioner: Patent Application No. 10-2012-0016202

A prior art document relating to the EHP type air conditioner: Patent Application No. 10-2003-0077857

In the EHP type air conditioner according to the related art, supplied current may be adjusted to easily control the compressor. Thus, the EHP type air conditioner may be adequate for response to a partial load and has high energy efficiency. However, the EHP type air conditioner may have a limitation in that frost is attached to an outdoor heat exchanger when low-temperature heating is performed.

On the other hand, the GHP type air conditioner may have an advantage in that waste heat of the engine is used to improve defrosting performance. However, the GHP type air conditioner may have low engine efficiency due to heat losses.

DISCLOSURE OF INVENTION

Technical Problem

Embodiments provide an air conditioner having improved heating performance and system efficiency and a method of controlling the same.

Solution to Problem

In one embodiment, an air conditioner includes: an indoor unit including an indoor heat exchanger; a first outdoor unit connected to the indoor unit, the first outdoor unit including a first compressor compressing a refrigerant and a first outdoor heat exchanger; a second outdoor unit including an engine generating a power by using combustion gas, a generator supplying electricity into the first compressor by using the power generated in the engine, a second compressor compressing the refrigerant by using the power of the engine, and a second outdoor heat exchanger; and a controller determining an additional operation of the second compressor on the basis of required cooling or heating load while the first compressor operates.

The air conditioner may further include: a first low-pressure sensor provided in the first outdoor unit to detect a suction-side pressure of the first compressor; and a first high-pressure sensor provided in the first outdoor unit to detect a discharge-side pressure of the first compressor.

It is determined that the pressure detected by the first low-pressure sensor is above a target low pressure while the cooling operation is performed, the controller may additionally drive the second compressor.

It is determined that the pressure detected by the first high-pressure sensor is below a target high pressure while the heating operation is performed, the controller may additionally drive the second compressor.

The air conditioner may further include: a cooling water tube guiding cooling water circulated into the engine; and a waste heat collection heat exchanger in which the cooling water flowing into the cooling water tube is heat-exchanged with the refrigerant circulated into the first outdoor unit.

The air conditioner may further include a cooling water pump provided in the cooling water tube to supply the cooling water into the waste heat collection heat exchanger, thereby heating the refrigerant introduced into the first outdoor heat exchanger.

The waste heat collection heat exchanger may include: a first waste heat collection heat exchanger in which the refrigerant introduced into the first outdoor heat exchanger is heat-exchanged; and a second waste heat collection heat exchanger in which the refrigerant introduced into the second outdoor heat exchanger is heat-exchanged.

The first waste heat collection heat exchanger and the second waste heat collection heat exchanger may be arranged in a line, and the cooling water within the cooling water tube may successively pass through the first waste heat collection heat exchanger and the second waste heat collection heat exchanger.

The air conditioner may further include a third compressor in the second outdoor unit, wherein the controller may determine an additional operation of the third compressor on the basis of the required cooling or heating load.

When it is determined that the pressure detected by the first low-pressure sensor is above a target low pressure while the second compressor additionally operates, the controller may additionally drive the third compressor.

The air conditioner may further include a third compressor in the second outdoor unit, wherein, when it is determined that the pressure detected by the first low-pressure sensor is above a target low pressure while the second compressor additionally operates, the controller may additionally drive the third compressor.

When a target operation torque of the engine for satisfying the cooling or heating load is above maximum torque of the engine while all of the second and third compressors operate, the controller may stop the operation of at least one compressor of the second and third compressors.

The air conditioner may further include a first refrigerant amount detection part for determining an amount of refrigerant circulated into the first outdoor unit in the first outdoor unit, wherein the first refrigerant amount detection part may include an inlet-side temperature sensor and an outlet-side temperature sensor of the first outdoor heat exchanger.

In another embodiment, a method of controlling an air conditioner includes: driving an engine provided in a gas heat pump (GHP) type outdoor unit to provide a power into a generator; supplying the power generated in the generator to drive a first compressor provided in an electric heat pump (EHP) type outdoor unit and a refrigeration cycle; determining whether the present pressure of the refrigeration cycle is above or below a target pressure; and comparing the present pressure of the refrigeration cycle to the target pressure to determine an operation of a second compressor provided in the GHP type outdoor unit.

The determining of whether the present pressure of the refrigeration cycle is above or below the target pressure may include: comparing the present low pressure of the refrigeration cycle to a target low pressure while a cooling operation is performed; and comparing the present high pressure of the refrigeration cycle to a target high pressure while a heating operation is performed.

When the present low pressure of the refrigeration cycle is above the target low pressure while the cooling operation is performed, the second compressor may operate.

When the present high pressure of the refrigeration cycle is below the target high pressure while the heating operation is performed, the second compressor may operate.

The GHP type outdoor unit may further include a third compressor, and the determining of whether the present pressure of the refrigeration cycle is above or below the target pressure may include: primarily comparing the present pressure of the refrigeration cycle to the target pressure to determine an operation of the second compressor; and secondarily comparing the present pressure of the refrigeration cycle to the target pressure in the state where the second compressor operates to determine an operation of the third compressor.

The method may further include determining whether a target operation torque of the engine is above maximum torque of the engine while all of the second and third compressors operate.

The method may further include stopping the operation of at least one compressor of the second and third compressors when it is determined that the target operation torque of the engine is above the maximum torque of the engine.

Advantageous Effects of Invention

According to the embodiments, the GHP type compressor and generator may operate by driving the engine provided in the GHP type outdoor unit, and the power generated by the generator may be supplied into the EHP type outdoor unit. Also, if the power of the generator supplied into the EHP is insufficient, the EHP may receive the power from the external power source to reduce electricity costs.

Also, since the GHP type outdoor unit and the EHP type outdoor unit are connected to a common tube to supply the waste heat generated in the GHP into the system, the heating performance and defrosting performance in the system may be improved.

Also, since the EHP type outdoor unit operates first to perform the cooling or heating operation, and then the GHP type outdoor unit additionally operates according to whether a pressure in the system reaches a preset pressure, i.e., the performance of the system is secured, customized operation according to the required load may be enable.

Also, when the plurality of compressors are provided in the GHP type outdoor unit, if the plurality of compressors operate to secure the system performance, the number of operating compressors may be controlled by calculating the target operation torque of the engine to prevent the operation torque of the engine from exceeding the maximum torque of the engine.

BRIEF DESCRIPTION OF DRAWINGS

FIG. 1 is a block diagram illustrating constitutions of an air conditioner according to an embodiment.

FIG. 2 is a view illustrating a refrigeration cycle in the air conditioner according to an embodiment.

FIG. 3 is a flowchart illustrating a method of controlling the air conditioner according to an embodiment.

FIG. 4 is a block diagram illustrating constitutions of an air conditioner according to another embodiment.

FIGS. 5 and 6 are flowcharts illustrating a method of controlling the air conditioner according to another embodiment.

MODE FOR THE INVENTION

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

FIG. 1 is a block diagram illustrating constitutions of an air conditioner according to an embodiment.

Referring to FIG. 1, an air conditioner 100 according to an embodiment includes a plurality of outdoor units 120 and 130 having a refrigeration cycle and an indoor unit 110 connected to the plurality of outdoor units 120 and 130.

In detail, the air conditioner 100 includes an electric heat pump (EHP) type first outdoor unit 120, a gas heat pump (GHP) type second outdoor unit 130, and an indoor unit connected to the first outdoor unit 120 and second outdoor unit 130 to cool or heat an indoor space.

The first outdoor unit 120 includes a first compressor 122 connected to an external power source 105 to compress a refrigerant and a first controller 120*a* controlling an operation of the first outdoor unit 120 or the first compressor 122.

The second outdoor unit 130 includes an engine 136 generating a power by using a combustion gas, a second compressor 132 operating by the power generated in the engine 136, and a second controller 130*a* controlling operations of a generator 138 and the second outdoor unit 130. The first controller 120*a* and the second controller 130*a* may be connected to communicate with each other. The first and second controllers 120*a* and 130*a* may be called a "controller".

The refrigerant compressed in the first and second compressors 122 and 132 may be circulated into the refrigeration cycle while being condensed, expanded, and evaporated.

The power generated in the generator 138 may be supplied into power components for the second outdoor unit 30. In addition, the power may also be supplied into the indoor unit 110.

Also, the first compressor 122 may operate by the power generated in the generator 138. That is, the first compressor 122 may operate by a power supplied from the generator 138 or the external power source 105. For example, the first compressor 122 may operate by the power supplied from the generator 138 in the ordinary way. However, if it is difficult to sufficiently secure the performance of the compressor by using only the power supplied from the generator 138, the under power may be supplemented through the power supplied from the external power source 105.

FIG. 2 is a view illustrating a refrigeration cycle in the air conditioner according to an embodiment.

Referring to FIG. 2, the indoor unit 110 includes an indoor heat exchanger 111 in which the refrigerant is heat-exchanged with air and an indoor fan 112 for blowing air toward the indoor heat exchanger 111.

The indoor unit 110 is connected to each of the first and second outdoor units 120 and 130 through a refrigerant tube 140. The first and second outdoor units 120 and 130 may selectively or simultaneously operate to supply the refrigerant into the indoor unit 110, thereby cooling or heating the indoor space.

For example, the refrigerant tube 140 in which the refrigerant introduced into the indoor unit 110 or discharged from the indoor unit 110 flows may be branched into a plurality of tubes and then connected to the first and second outdoor units 120 and 130. That is, the refrigerant discharged from the indoor unit 110 may be branched, and then the branched refrigerant may be introduced into the first and second outdoor units 120 and 130. The refrigerant discharged from the first and second outdoor units 130 may be combined with each other, and then the combined refrigerant may be introduced into the indoor unit 110.

The first outdoor unit 120 includes a first outdoor heat exchanger 121 that is heat-exchanged with outdoor air and the first compressor 122 operating by the power supplied from the external power source 105 or the generator 138. Also, the first outdoor unit 120 further includes an accumulator 123 for separating a liquid refrigerant from the refrigerant introduced into the first compressor 122, a four-way valve 124 for switching a flow direction of the refrigerant, and an outdoor fan 125.

The second outdoor unit includes a second outdoor heat exchanger 131 that is heat-exchanged with outdoor air and the second compressor 132 operating by the engine 136. Also, the second outdoor unit 130 further includes an accumulator 133, a four-way valve 134, and an outdoor fan 135.

The second outdoor unit 130 further includes a cooling water tube 210 for cooling the engine 136. The cooling water tube 210 may include a close loop-passage. Cooling water may flow into the cooling water tube 210 to absorb heat of the heated engine 136. A cooling water pump 215 for providing a flow force of the cooling water may be disposed in the cooling water tube 210.

The air conditioner 100 includes a waste heat collection heat exchanger 220 in which the refrigerant introduced into each of the first and second outdoor heat exchangers 121 and 131 is heat-exchanged with the cooling water of the cooling water tube 210.

Here, when the air conditioner 100 performs the heating operation, the refrigerant may be condensed in the outdoor heat exchanger 111 and be evaporated in each of the first and second outdoor heat exchangers 121 and 131.

On the other hand, when the air conditioner 100 performs the cooling operation, the refrigerant may be condensed in the first and second outdoor heat exchangers 121 and 131 and be evaporated in the indoor heat exchanger 111.

In detail, the waste heat collection heat exchanger 220 includes a first waste heat collection heat exchanger 221 in which the refrigerant introduced into the first outdoor heat exchanger 121 is heat-exchanged and a second waste heat collection heat exchanger 222 in which the refrigerant introduced into the second outdoor heat exchanger 131 is heat-exchanged.

In the first waste heat collection heat exchanger 221, the refrigerant tube 141 in which the refrigerant introduced into the first outdoor heat exchanger 121 flows and the cooling water tube 210 in which the high-temperature cooling water flows are heat-exchanged therebetween. For example, the refrigerant of the refrigerant tube 141 may absorb heat from the high-temperature cooling water.

In the second waste heat collection heat exchanger 222, the refrigerant tube 142 in which the refrigerant introduced into the second outdoor heat exchanger 131 flows and the cooling water tube 210 in which the high-temperature cooling water flows are heat-exchanged therebetween. For example, the refrigerant of the refrigerant tube 142 may absorb heat from the high-temperature cooling water.

The first waste heat collection heat exchanger 221 and the second waste heat collection heat exchanger 222 may be arranged in a line so that the single cooling water tube 210 passes therethrough. Thus, the cooling water heated while passing through the engine 136 may successively pass through the second waste heat collection heat exchanger 222 and the first waste heat collection heat exchanger 221.

However, the present disclosure is not limited thereto. For example, the cooling water may successively pass through the first waste heat collection heat exchanger 221 and the second waste heat collection heat exchanger 222. For example, the first and second waste heat collection heat exchangers 221 and 222 may be arranged so that the cooling water preferentially passes through the water heat collection heat exchanger having a relatively low refrigerant temperature.

Here, the heat exchange may occur due to a difference in temperature of the refrigerant and the cooling water in the first and second waste heat collection heat exchangers 221 and 222.

In detail, in the first waste heat collection heat exchanger 221, since the refrigerant introduced into the first outdoor heat exchanger 121 is expanded in an expansion valve 126 after being condensed in the indoor unit 110 and thus becomes to a low-temperature low-pressure state, heat may be transferred from the high-temperature cooling water to the refrigerant. Thus, when a low-temperature heating operation is performed, a temperature of the refrigerant introduced into the first outdoor heat exchanger 121 may increase to improve the heating performance and help defrosting for the first outdoor heat exchanger 121.

Similarly, in the second waste heat collection heat exchanger 222, heat may be transferred from the cooling water to the low-temperature refrigerant that is expanded in the expansion valve 137. Thus, a temperature of the refrigerant introduced into the second outdoor heat exchanger 131 may increase to improve the heating performance and help defrosting for the second outdoor heat exchanger 131.

The first outdoor unit 120 includes a first low-pressure sensor 129*a* for detecting a pressure of the evaporated refrigerant, i.e., the refrigerant to be introduced into the first compressor 122, i.e., a low pressure in the refrigeration cycle and a first high-pressure sensor 129*b* for detecting a pressure of the refrigerant discharged from the first compressor 122, i.e., a high-pressure in the refrigeration cycle.

FIG. 3 is a flowchart illustrating a method of controlling the air conditioner according to an embodiment. A method of controlling the air conditioner according to an embodiment will be described with reference to FIG. 3.

When an air conditioner 100 operates, an engine 136 provided in a GHP type second outdoor unit 130 may operate. Here, the engine 136 may operate to generate a power. Thus, a generator 138 may operate by using the generated power.

Also, in operations S11, S12, and S13, the power generated in the generator 138 may be supplied into a first compressor 122 provided in an EHP type first indoor unit 120, and the first compressor 122 may operate by using the power of the generator 138.

Since the first compressor 122 operates, the air conditioner 100 may perform a cooling or heating operation. In operation S14, an operation mode with respect to the cooling or heating operation may be determined.

When the air conditioner 100 performs the cooling operation, the first outdoor unit 120 may operate according to the cooling operation mode. That is, the refrigerant compressed in the first compressor 122 may be condensed in a first outdoor heat exchanger 121, be expanded in an expansion valve 126, and be evaporated in an indoor heat exchanger 111. Also, in operations S15 and S16, the evaporated refrigerant may be introduced again into the first compressor 122.

While the cooling operation is performed, a low pressure of a refrigeration cycle due to the first outdoor unit 120 may be detected by using a first low-pressure sensor 129*a*. Also, it may be determined whether the present low-pressure of the refrigeration cycle, which is detected by the first low-pressure sensor 129*a*, is above a target low pressure. If the present low pressure is above the target low pressure, it may be determined that the refrigeration cycle that operates at the present does not satisfy a cooling load in the air conditioner 100. A first controller 120*a* may transmit the determined information into a second controller 130*a*.

Also, the second controller 130*a* may drive a second compressor provided in the second outdoor unit 130. Here, an output of the engine 136 may increase. Also, a power supplied from the engine 136 may be supplied into the second compressor 132 as well as the generator 138. In operations S17 and S18, the second compressor 132 may operate.

On the other hand, in the operation S17, if the present low pressure is below the target low pressure, it may be determined that the refrigeration cycle that operates at the present satisfies the cooling load required in the air conditioner 100. Thus, it may be unnecessary to allow the refrigeration cycle of the second outdoor unit 130 to operate. Thus, the operation S16 may be continuously performed.

As described above, when the cooling operation is performed, since the refrigeration cycle of the first outdoor unit 120 operates by using the engine 136 of the second outdoor unit 130, and the refrigeration cycle of the second outdoor unit 130 additionally operates according to whether the cooling load is satisfied, the unnecessary operation of the air conditioner may be minimized to improve performance in system.

In the operation S15, when the air conditioner 100 performs the heating operation, the first outdoor unit 120 may operate according to the heating operation mode. That is, the refrigerant compressed in the first compressor 122 may be condensed in the indoor heat exchanger 111, be expanded in the expansion valve 126, and be evaporated in the first outdoor heat exchanger 121. Also, in operation S19, the evaporated refrigerant may be introduced again into the first compressor 122.

While the air conditioner 100 performs the heating operation, the refrigerant flowing into the first outdoor unit 120 may be heat-exchanged with cooling water in a first waste heat collection heat exchanger 221. Here, a cooling water pump 215 may operate to circulate the cooling water into a cooling water tube 210. While the refrigerant and the cooling water of the first outdoor unit 120 are heat-exchanged with each other, the refrigerant may absorb heat or be heated.

As described above, since the waste heat of the engine 136 is collected to supply the collected heat into the refrigerant, defrosting performance of the first outdoor heat exchanger 121 may be improved, and heating efficiency may be improved in operation S20.

While the air conditioner 100 performs the heating operation, a high pressure of the refrigeration cycle may be detected by using a first high-pressure sensor 129*b*. Also, it may be determined whether the present high-pressure of the refrigeration cycle, which is detected by the first high-pressure sensor 129*a*, is below a target high pressure. If the present high pressure is below the target high pressure, it may be determined that the refrigeration cycle that operates at the present does not satisfy a heating load required in the air conditioner 100.

Thus, the second controller 130*a* may drive a second compressor provided in the second outdoor unit 130. Here, an output of the engine 136 may increase. Also, a power supplied from the engine 136 may be supplied into the second compressor 132 as well as the generator 138. In operations S18 and S21, the second compressor 132 may operate.

On the other hand, in the operation S21, if the present high pressure is above the target high pressure, it may be determined that the refrigeration cycle that operates at the present satisfies the heating load required in the air conditioner 100. Thus, it may be unnecessary to allow the refrigeration cycle of the second outdoor unit 130 to operate. Thus, the operations S19 and S20 may be continuously performed.

As described above, when the heating operation is performed, since the refrigeration cycle of the first outdoor unit 120 operates by using the engine 136 of the second outdoor unit 130, and the refrigeration cycle of the second outdoor unit 130 additionally operates according to whether the heating load is satisfied, the unnecessary operation of the air conditioner may be minimized to improve performance in system.

Hereinafter, a description will be made according to another embodiment. Since the current embodiment is the same as the foregoing embodiment except for portions of the constitutions and the control method, different parts between the embodiments will be described principally, and descriptions of the same parts will be denoted by the same reference numerals and descriptions of the foregoing embodiment.

FIG. 4 is a block diagram illustrating constitutions of an air conditioner according to another embodiment.

Referring to FIG. 4, an air conditioner 100 according to another embodiment includes a first compressor 122, a first low-pressure sensor 129*a*, a first high-pressure sensor 129*b*, and a first outdoor unit 120 including a first refrigerant amount detection part 129*c*.

The first refrigerant amount detection part 129*c* includes an inlet-side temperature sensor and an outlet-side temperature sensor of a first outdoor heat exchanger 121. A circulating refrigerant amount may be determined on the basis of a difference in inlet and outlet-side temperature of the first outdoor heat exchanger 121.

For example, if the difference in inlet and outlet-side temperature of the first outdoor heat exchanger 121 is greater than a preset temperature, it may be determined that the refrigerant amount is less than a preset amount. On the other hand, if the difference in inlet and outlet-side temperature of the first outdoor heat exchanger 121 is less than the preset temperature, it may be determined that the refrigerant amount is relatively greater than the preset amount.

The air conditioner 100 further includes a second outdoor unit 130 including a plurality of compressors 132*a* and 132*b*. The plurality of compressors 132*a* and 132*b* include a second compressor 132*a* and a third compressor 132*b*.

The second outdoor unit 130 further includes a second low-pressure sensor 139*a* for detecting a low pressure of a refrigeration cycle that operates by the second outdoor unit 130, a second high-pressure sensor 139*b* for detecting a high pressure of the refrigeration cycle, and a second refrigerant amount detection part 139*c* for detecting an amount of refrigerant circulated into the refrigeration cycle.

The second refrigerant amount detection part 139*c* includes an inlet-side temperature sensor and an outlet-side temperature sensor of a second outdoor heat exchanger 131. A circulating refrigerant amount may be determined on the basis of a difference in inlet and outlet-side temperature of the second outdoor heat exchanger 131.

FIGS. 5 and 6 are flowcharts illustrating a method of controlling the air conditioner according to another embodiment. A method of controlling the air conditioner according to another embodiment will be described with reference to FIGS. 5 and 6.

When an air conditioner 100 operates, an engine 136 provided in a GHP type second outdoor unit 130 may operate. Here, the engine 136 may operate to generate a power. Thus, a generator 138 may operate by using the generated power. Also, in operations S31, S32, and S33, the power generated in the generator 138 may be supplied into a first compressor 122 provided in an EHP type first indoor unit 120, and the first compressor 122 may operate by using the power of the generator 138.

Since the first compressor 122 operates, the air conditioner 100 may perform a cooling or heating operation. In operation S34, an operation mode with respect to the cooling or heating operation may be determined.

When the air conditioner 100 performs the cooling operation, the first outdoor unit 120 may operate in the cooling operation mode. That is, the refrigerant compressed in the first compressor 122 may be condensed in a first outdoor heat exchanger 121, be expanded in an expansion valve 126, and be evaporated in an indoor heat exchanger 111. Also, in operations S35 and S36, the evaporated refrigerant may be introduced again into the first compressor 122.

While the cooling operation is performed, a low pressure of a refrigeration cycle may be detected (primarily detected) by using a first low-pressure sensor 129*a*. Also, the first controller 120*a* may determine whether the present low-pressure of the refrigeration cycle, which is detected by the first low-pressure sensor 129*a*, is above a target low pressure.

If the present low pressure is above the target low pressure, the first controller 120*a* may transmit the determined information into a second controller 130*a*. Thus, the second controller 130*a* may drive a second compressor 132*a* provided in the second outdoor unit 130. Here, an output of the engine 136 may increase. Also, a power supplied from the engine 136 may be supplied into the second compressor 132*a* as well as the generator 138. In operations S37 and S38, the second compressor 132*a* may operate.

On the other hand, in the operation S37, if the present low pressure is below the target low pressure, it may be unnecessary to allow the refrigeration cycle of the second outdoor unit 130 to operate. Thus, the operation S36 may be continuously performed.

While the second compressor 132*a* operates, a lower pressure of the refrigeration cycle of the first outdoor unit 120 may be detected again (secondarily detected) by using the first low-pressure sensor 129*a*. Also, it may be determined whether the present low-pressure of the refrigeration cycle, which is detected by the first low-pressure sensor 129*a*, is above a target low pressure. Here, alternatively, the low pressure of the refrigeration cycle due to the second outdoor unit 130 may be detected again (secondarily detected) by using a second low-pressure sensor 139*a*, and the detected low pressure may be compared to the other target low pressure.

When the present low pressure is above the target low pressure, the third compressor 132*b* provided in the second outdoor unit 130 may additionally operate. Here, an output of the engine 136 may increase. Also, a power supplied from the engine 136 may be supplied into the second and third compressors 132*a* and 132*b* as well as the generator 138. In operations S39 and S40, the second and third compressors 132*a* and 132*b* may operate.

On the other hand, in the operation S39, if the present low pressure is below the target low pressure, it may be unnecessary to allow the refrigeration cycle of the second outdoor unit 130 to operate. Thus, the operation S38 may be continuously performed.

While the operation S40 is performed, target operation torque of the engine 136 may be determined. The target operation torque of the engine 136 may be understood as operation torque of the engine 136 for satisfying a cooling load required in the air conditioner 100.

The target operation torque of the engine 136 may be determined on the basis of information with respect to a suction/discharge pressure of the first compressor 122, a suction/discharge pressure of the second compressor 132*a*, and a suction/discharge pressure of the third compressor 132*b* and information with respect to an amount of refrigerant circulated into the refrigeration cycle by the first outdoor unit 120 and an amount of refrigerant circulated into the refrigeration cycle by the second outdoor unit 130.

The suction/discharge pressures of the first to third compressors 122, 132*a*, and 132*b* may be detected through the low-pressure sensors 129*a* and 139*a* and high-pressure sensors 129*b* and 139*b* of the refrigeration cycle, respectively.

Also, the amount of refrigerant circulated into the refrigeration cycle by the first outdoor unit 120 may be determined by the first refrigerant amount detection part 129*c*, and the amount of refrigerant circulated into the refrigeration cycle by the second outdoor unit 130 may be determined by the second refrigerant amount detection part 139*c*.

It is determined whether the target operation torque of the engine 136 is above maximum torque of the engine 136. Here, the maximum torque of the engine 136 may be understood as maximum performance of the engine 136.

If the target operation torque of the engine 136 is above the maximum torque of the engine 136, the engine 136 may be overloaded while the air conditioner 100 operates to cause breakdown or errors of the air conditioner 100. Here, the second controller 130*a* may stop an operation of one compressor of the plurality of compressors 132*a* and 132*b* of the second outdoor unit 130. For example, in operation S41 and S42, the operation of the third compressor 132*b* may be stopped.

On the other hand, if the target operation torque of the engine 136 is below the maximum torque of the engine 136, the second and third compressors 132*a* and 132*b* may continuously operate in operation S43.

As described above, when the cooling operation is performed, if all of the plurality of compressors 132*a* and 132*b* of the second outdoor unit 130 operate, the air conditioner may have limited engine output. Also, if the target operation torque is above the maximum torque of the engine 136, a portion of the compressors may be stopped in operation. Thus, the air conditioner 100 may stably perform the cooling operation.

In the operation S35, when the air conditioner 100 performs the heating operation, the first outdoor unit 120 may operate according to the heating operation mode. That is, the refrigerant compressed in the first compressor 122 may be condensed in the indoor heat exchanger 111, be expanded in the expansion valve 126, and be evaporated in the first outdoor heat exchanger 121. Also, in operation S51, the evaporated refrigerant may be introduced again into the first compressor 122.

While the air conditioner 100 performs the heating operation, the refrigerant flowing into the first outdoor unit 120 may be heat-exchanged with cooling water in a first waste heat collection heat exchanger 221. Here, a cooling water pump 215 may operate to circulate the cooling water into a cooling water tube 210. While the refrigerant and the cooling water of the first outdoor unit 120 are heat-exchanged with each other, the refrigerant may absorb heat.

As described above, since the waste heat of the engine 136 is collected to supply the collected heat into the refrigerant, defrosting performance of the first outdoor heat exchanger 121 may be improved, and heating efficiency may be improved in operation S52.

While the air conditioner 100 performs the heating operation, a high pressure of the refrigeration cycle may be detected (primarily detected) by using a first high-pressure sensor 129*b*. Also, it may be determined whether the present high-pressure of the refrigeration cycle, which is detected by the first high-pressure sensor 129*a*, is below a target high pressure.

When the present high pressure is below the target low pressure, the third compressor 132*b* provided in the second outdoor unit 130 may operate. Here, an output of the engine 136 may increase. Also, a power supplied from the engine 136 may be supplied into the second compressor 132*a* as well as the generator 138. In operations S53 and S54, the second compressor 132*a* may operate.

On the other hand, in the operation S53, if the present high pressure is above the target high pressure, it may be determined that the refrigeration cycle that operates at the present satisfies the heating load required in the air conditioner 100. Thus, it may be unnecessary to allow the refrigeration cycle of the second outdoor unit 130 to operate. Thus, the operations S51 and S52 may be continuously performed.

While the second compressor 132*a* operates, a high pressure of the refrigeration cycle of the first outdoor unit 120 may be detected again (secondarily detected) by the first high-pressure sensor 129*b*. Also, it may be determined whether the present high-pressure of the refrigeration cycle, which is detected by the first high-pressure sensor 129*a*, is below a target high pressure. Here, alternatively, the high pressure of the refrigeration cycle due to the second outdoor unit 130 may be detected again (secondarily detected) by using a second low-pressure sensor 139*a*, and the detected high pressure may be compared to the other target high pressure in operation S55.

When the present high pressure is below the target low pressure, the third compressor 132*b* provided in the second outdoor unit 130 may additionally operate. Here, an output of the engine 136 may increase. Also, a power supplied from the engine 136 may be supplied into the second and third compressors 132*a* and 132*b* as well as the generator 138. In operations S39 and S40, the second and third compressors 132*a* and 132*b* may operate.

On the other hand, in the operation S55, if the present high pressure is below the target high pressure, it may be unnecessary to allow the refrigeration cycle of the second outdoor unit 130 to operate. Thus, the operation S54 may be continuously performed.

While the operation S56 is performed, target operation torque of the engine 136 may be determined. The target operation torque of the engine 136 may be understood as operation torque of the engine 136 for satisfying a heating load required in the air conditioner 100.

The target operation torque of the engine 136 may be determined on the basis of information with respect to a suction/discharge pressure of the first compressor 122, a suction/discharge pressure of the second compressor 132*a*, and a suction/discharge pressure of the third compressor 132*b* and information with respect to an amount of refrigerant circulated into the refrigeration cycle by the first outdoor unit 120 and an amount of refrigerant circulated into the refrigeration cycle by the second outdoor unit 130.

It is determined whether the target operation torque of the engine 136 is above maximum torque of the engine 136. Here, in operation S136, the maximum torque of the engine 136 may be understood as maximum performance of the engine 136.

If the target operation torque of the engine 136 is above the maximum torque of the engine 136, one of the plurality of compressors 132*a* and 132*b* may be stopped in operation. For example, in operation S58, the operation of the third compressor 132*b* may be stopped.

On the other hand, if the target operation torque of the engine 136 is below the maximum torque of the engine 136, the second and third compressors 132*a* and 132*b* may continuously operate in operation S59.

As described above, when the heating operation is performed, if all of the plurality of compressors 132*a* and 132*b* of the second outdoor unit 130 operate, the air conditioner may have limited engine output. Also, if the target operation torque is above the maximum torque of the engine 136, a portion of the compressors may be stopped in operation. Thus, the air conditioner 100 may stably perform the heating operation.

INDUSTRIAL APPLICABILITY

According to the embodiments, the GHP type compressor and generator may operate by driving the engine provided in the GHP type outdoor unit, and the power generated by the generator may be supplied into the EHP type outdoor unit. Also, if the power of the generator supplied into the EHP is insufficient, the EHP may receive the power from the external power source to reduce electricity costs. Therefore, industrial applicability is significantly high.

The invention claimed is:

1. An air conditioner, comprising:

an indoor unit comprising an indoor heat exchanger;

a first outdoor unit connected to the indoor unit, the first outdoor unit comprising a first compressor that compresses a refrigerant and a first outdoor heat exchanger;

a second outdoor unit comprising an engine that generates power using a combustion gas, a generator that supplies electricity to the first compressor using the power generated in the engine, a second compressor and a third compressor that compress the refrigerant using the power of the engine, and a second outdoor heat exchanger; and a controller that determines an operation of the second compressor or the third compressor based on a required cooling or heating load while the first compressor operates, wherein when a target operation torque of the engine for satisfying the cooling or heating load is above a maximum torque of the engine while all of the second and third compressors operate, the controller stops the operation of at least one compressor of the second and third compressors.

2. The air conditioner according to claim 1, further comprising:

a low-pressure sensor provided in the first outdoor unit to detect a suction-side pressure of the first compressor; and a high-pressure sensor provided in the first outdoor unit to detect a discharge-side pressure of the first compressor.

3. The air conditioner according to claim 2, wherein when the pressure detected by the low-pressure sensor is above a target low pressure while a cooling operation is performed, the controller drives the second compressor.

4. The air conditioner according to claim 2, wherein when the pressure detected by the high-pressure sensor is below a target high pressure while a heating operation is performed, the controller drives the second compressor.

5. The air conditioner according to claim 1, further comprising:

a cooling water tube that guides cooling water circulated into the engine; and a waste heat collection heat exchanger in which the cooling water flowing into the cooling water tube is heat-exchanged with the refrigerant circulated into the first outdoor unit.

6. The air conditioner according to claim 5, further comprising a cooling water pump provided in the cooling water tube to supply the cooling water into the waste heat collection heat exchanger, thereby heating the refrigerant introduced into the first outdoor heat exchanger.

7. The air conditioner according to claim 5, wherein the waste heat collection heat exchanger comprises:

a first waste heat collection heat exchanger in which the refrigerant introduced into the first outdoor heat exchanger is heat-exchanged; and a second waste heat collection heat exchanger in which the refrigerant introduced into the second outdoor heat exchanger is heat-exchanged.

8. The air conditioner according to claim 7, wherein the first waste heat collection heat exchanger and the second waste heat collection heat exchanger are arranged in a line, and the cooling water within the cooling water tube successively passes through the first waste heat collection heat exchanger and the second waste heat collection heat exchanger.

9. The air conditioner according to claim 1, wherein, when the pressure detected by the low-pressure sensor is above a target low pressure while the second compressor operates, the controller drives the third compressor.

10. The air conditioner according to claim 1, wherein, when the pressure detected by the low-pressure sensor is above a target low pressure while the second compressor operates, the controller drives the third compressor.

11. The air conditioner according to claim 1, further comprising a first refrigerant amount detector that determines an amount of refrigerant circulated in the first outdoor unit, wherein the first refrigerant amount detector comprises an inlet-side temperature sensor and an outlet-side temperature sensor of the first outdoor heat exchanger.

* * * * *